United States Patent [19]

Krakauer

[11] Patent Number: 4,458,943

[45] Date of Patent: Jul. 10, 1984

[54] SPRING SEAT

[75] Inventor: Daniel Krakauer, Great Neck, N.Y.

[73] Assignee: Kay Springs, Incorporated, Syosset, N.Y.

[21] Appl. No.: 362,648

[22] Filed: Mar. 29, 1982

Related U.S. Application Data

[63] Continuation-in-part of Ser. No. 315,272, Oct. 26, 1981, which is a continuation of Ser. No. 60,062, Jul. 24, 1979, abandoned, which is a continuation of Ser. No. 720,983, Sep. 7, 1976, abandoned.

[51] Int. Cl.[3] ..... A47C 7/02

[52] U.S. Cl. ..... 297/452; 297/459

[58] Field of Search ..... 297/452, 458, 459, 284; 5/402, 476; 267/103, 105, 165, 85, 80

[56] References Cited

U.S. PATENT DOCUMENTS

| | | | |
|---|---|---|---|
| 2,362,585 | 11/1944 | Robinson | 267/85 |
| 2,557,269 | 6/1951 | Fox | 297/452 |
| 2,942,652 | 6/1960 | Chapman | 297/458 |
| 3,587,569 | 6/1971 | Madsen | 297/284 |
| 4,077,669 | 3/1978 | Fox | 297/452 |

FOREIGN PATENT DOCUMENTS

| | | | |
|---|---|---|---|
| 2734285 | 9/1978 | Fed. Rep. of Germany | 297/452 |
| 343628 | 2/1931 | United Kingdom | 297/452 |
| 991196 | 5/1965 | United Kingdom | 297/452 |

*Primary Examiner*—Francis K. Zugel

[57] ABSTRACT

A spring seat for accommodating the depending ischial tuberosities and to reduce the load on them by supporting the ischial tuberosities at a lower level than the supporting means under the buttocks of a seated occupant which take on a significant portion of the load.

10 Claims, 5 Drawing Figures

SPRING SEAT

BACKGROUND AND OBJECTIVES OF THE INVENTION

This application is a continuation-in-part application of application Ser. No. 315,272 filed on Oct. 26, 1981 which was a continuation application of Ser. No. 60,062 filed July 24, 1979 which was a continuation of Ser. No. 720,983 filed Sept. 7, 1976, the two latter applications now being abandoned.

"Small" chairs, as that term is used herein, are chairs having a limited seating area just adequate to seat adults properly with little or no spare space. There are many types of small chairs. Each type usually has its own characteristics and structure, and the seat size or conventional width varies within a narrow range. For example, small chairs may be foldable or stackable with seats substantially 38.5 cm. wide, dining chairs are substantially 43.0 cm. along their front edges, arm chairs substantially 53.5 cm. along their front edges and slung chairs substantially 41.0 cm.

Most small chairs presently in general use that have been mass produced are relatively uncomfortable. Usually they are constructed without spring or elastic elements and utilize plywood, pressboard or a metal base having a thickness that will depend upon the intended use of the chair. Urethane padding over the chair seat or base is but one attempt to overcome the pressure to which the chair occupant will be subjected at the ischial tuberosities. However, such padding "bottoms out" usually when subjected to repeated loadings and is unsatisfactory generally for distributing and supporting the occupant's load so that the padding presses on the under thigh surfaces of the occupant and reduces blood circulation in the thighs tending to pinch and make seating uncomfortable and sometimes painful.

British Pat. No. 1,539,681 is illustrative of applicant's earlier concept which incorporates many of the ranges of measurements in adults to permit a dependable average to be obtained of the distance between the ischial tuberosities which have been found to vary insignificantly but cover an average range in adults between 12.2 cm. and 14.2 cm., averaging 13.2 cm.

Other prior art references for chair seats that exhibit supporting means include British Pat. No. 343,628 (Holland), U.S. Pat. No. 1,496,634 (Hettinger).

However, as will become apparent, these references do not suggest or contemplate the present structure of this invention.

Quite significantly, the prior art does not recognize the fact that the ischial tuberosities depend $1\frac{3}{4}$ inches plus/minus $\frac{1}{4}$ inch below the compressed buttocks in the majority of adults thereby providing further substantiation to the novelty of the structure of the present seat which is designed to accommodate fully the depending ischial tuberosities and to reduce the load on them. Even the use of a three inch thickness of urethane foam cushioning is insufficient to reduce significantly the weight of the trunk on the ischial tuberosities since the urethane foam innately is unable to develop enough support at partial compression under the buttocks to take on a significant portion of the load.

The present invention is based upon anthropometric, anatomical and physiological data, some of which is relatively new.

The two ischial tuberosities (seat bones) extend $1\frac{3}{4}$ inches plus/minus $\frac{1}{4}$ inch below the compressed buttocks when a person is in a sitting position. Thus when a person sits on a firm surface, the ischial tuberosities contact it firmly and carry the full weight of the trunk under their very limited area. Pressures can exceed 100 pounds per square inch, producing pain and leading to squirming, knee crossing, which shifts the contact area somewhat. Innattention and distraction frequently occur from such discomfort. In these common circumstances, although the rest of the buttocks is in contact with the seating surface, they are not compressed sufficiently to bear any significant portion of the trunk load.

The purpose of foam cushioning, padding, and springing alone or in combination is to spread the load by permitting the ischial tuberosities to sink more deeply, and for the buttocks to become further compressed and to share the weight of the head, arms and trunk. Whereas four inch thick, firm urethane foam, or foam over springs, can produce a comfortable seat, this type of structure requires considerable depth and furniture of substantial proportions. Most utilitarian seating such as office chairs, dinette sets, folding chairs, stacking chairs, auditorium seating, etc. is much lighter and much less expensive and usually affords a depth of only one or two inches to cushion the chair occupant. The seats of various chairs of the latter sort vary from a flat plywood or metal panel without upholstering to somewhat concave configurations with or without upholstering and to a base with an inch or two of urethane foam or some other type of padding.

In view of the anatomical configuration mentioned heretofore, especially the sharp obtrusion of the ischial tuberosities, clearly it is most difficult to achieve a comfortable spreading of the sitting load in such limited depth. The most common approach, an inch or two of urethane foam over a firm platform, typically becomes uncomfortable within a few minutes. Foam has a tendency, as indicated above, to pack under load. The foam under the seat bones packs down very rapidly, whereas the partially compressed foam under the buttocks provides miniscule support. Thus, the occupant quickly finds himself with almost the same discomfort as if the foam were not present.

Although there is considerable variation in individuals regarding what particular load distribution is most comfortable when sitting, as well as the added factors of the height of the seat, the type of back support, if any, whether arm rests are employed, etc., it has been found that a sense of comfort is achieved when approximately one-third of the trunk load is carried by the two ischial tuberosities, and about two-thirds of the load is distributed over the rest of the buttocks and under the thighs.

The essence of the present invention is a deceptively simple way to produce a contour seat which spreads the load of the trunk, head and arms so that a high sense of comfort is attained and yet only the two tensioned members under the ischial tuberosities move downwardly any significant amount. This is achieved by employing two elastic straps or springs centered about $5\frac{1}{4}$ inches apart (the ischial tuberosity separation plus or minus one-half inch in 95 percent of the adult population), and in a chair which is not too wide to constrain the sitting location of the occupant, causing his ischial tuberosities to land on the elastic straps or springs and depress them about $1\frac{1}{2}$ to 2 inches; at which time the two firmer straps exterior to the two inner springs receive and compress the buttocks with little or no depression of their own.

The exterior supports located about one inch on each side of the pair of inner supports may be either relatively firm webbing or two semi-rigid very firm spring strips that conform somewhat to the buttocks but depress very little. At this stabilized point, the support provided by the two inner and softer spring strands will equal about one-third of the total load on the seat, and the support provided by the outer platform or very firm spring strands or webbing plus the framing structure in the front and sides will provide about two-thirds of the support of the load on the seat.

Thus, the invention provides in minimal and very economical form, a seat contoured to the anatomy of the occupant, providing the sensation of full comfort and springiness, yet requiring a depth of but 2-inches maximum.

The specific resilience or spring rate of the two inner strands, when made from short pieces of sinuous springs of standard format and slight arc, that develops the correct pressure after being depressed by the ischial tuberosities has usually been achieved with the use of 10 or 11 gauge spring wire. The exterior bands have either flat spring, metal, relatively firm flexible webbing or approximately 8 gauge sinuous springs of very firm format. The overall result, of course, varies with the amount of padding and the manner in which the seat is upholstered. However, it has been found that there is enough leeway in human perception to provide a sense of comfort and springiness to occupants of either sex having a full range of anatomical proportions. There is a definite range of parameters, and the inner strands must be located under the ischial tuberosities to be fully effective and assume the full contour. This is a marked departure from those references with random sized frames and where weak supports for the upholstering are inserted simply to fill the void or space within the frame exterior.

The provision of a novel seat construction which will accommodate and support the ischial tuberosities at a lower level than the rest of the buttocks and thighs, will become more readily apparent to those skilled in the seating art when taken in conjunction with the accompanying drawing and claims in which equivalents and variations are contemplated to accomplish the objectives and purposes of this invention.

DETAILED DESCRIPTION OF PREFERRED EMBODIMENTS

Figure 1:
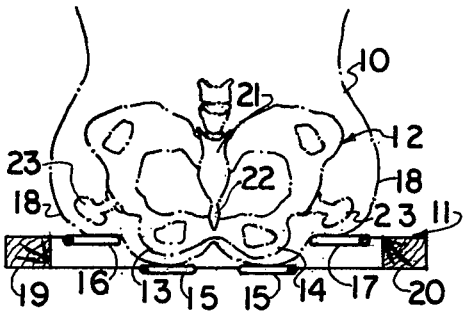
FIG. 1 is a schematic illustration of a transverse sectional view of a spring seat embodying the invention in conjunction with a partial skeletal view of a seated occupant illustrating the significant pelvic sitting position on the seat.

Referring to the drawing and particularly to FIG. 1, there is illustrated, in outline form, the lower torso 10 of a seated person occupying the spring seat 11 in which the pelvic area 12 is shown with the ischial tuberosities 13 and 14 positioned on the inner medially tensioned bands 15 in the loaded and depressed condition while the outer tensioned stiffer bands 16 and 17 support the occupant's buttocks 18 with the bands being spaced from the sides 19 and 20 of the frame of the seat 11.

The sacrum 21 and the coccyx 22 are positioned centrally of the ischial tuberosities or seat bones as part of the pelvic girdle with the femur 23 being shown also in outline form in juxtaposition to the ischial tuberosities and the fleshy buttocks that will be supported on the band 16 and 17. The spacing between the ischial tuberosities is approximately 5¼ inches in the greated majority of adults.

Figure 2:
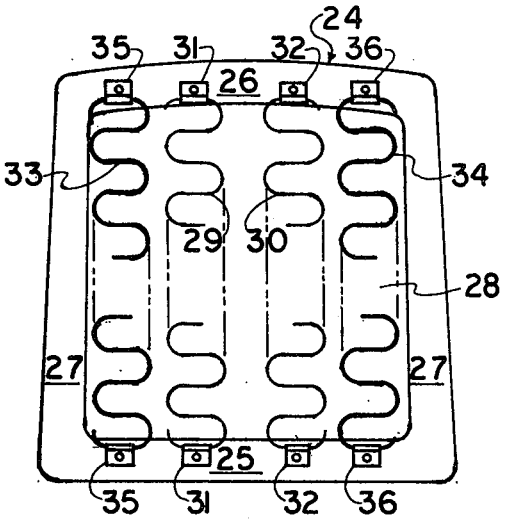
FIG. 2 is a top plan view of one embodiment of a spring seat construction employing sinuous springs in spaced lateral relation to each other.

In FIG. 2, the seat frame perimeter 24 is provided with a front rail 25, a rear rail 26 and a pair of side rails 27 suitably joined together to provide the central opening 28 which is spanned by transversely extending and spaced apart medial tensioned sinuous spring bands 29 and 30 that are securely fastened to the front and rear rails 25 and 26 of the seat frame 24 by suitable spring clips 31 and 32 which are securely fastened to the seat frame by suitable fastening members. The medial bands 29 and 30 are spaced apart cooperatively to receive and support thereon the ischial tuberosities as shown in FIG. 1. The support provided by the two inner and softer spring strands 29 and 30 will support approximately one-third of the seated occupant's total load. A pair of laterally spaced tensioned sinuous bands or springs 33 and 34 are positioned and supported laterally from the bands 29 and 30 and are secured in position by means of the spring clips 35 and 36 at the spring ends in a conventional manner and secured to the seat frame by suitable fastening members such as screws, rivets or bolts. It will be readily apparent that the sinuous springs 29, 30, 33 and 34 are continuous although only portions are illustrated.

The outer spring bands or springs 33 and 34 and the seat platform with its rails or sides 27 are very firm, and together with the front and rear rails, will support approximately two-thirds of the occupant's load on the seat.

The specific resilience or spring rate of the two inner strands 20 and 30 may be made from short sections of sinuous springs of standard format and each has a slight upward arc, preferably, to coincide substantially with the curvature of the outer springs or bands 33 and 34 so that the correct pressure after being depressed by the ischial tuberosities will assume the configuration shown in FIG. 1. It has been found that desirable results may be achieved by using 10 or 11 gauge spring wire made up into the sinuous springs 31 and 32. The outer bands or springs 33 and 34 may be constructed of 8 gauge spring wire to obtain a very firm format.

Figure 3:
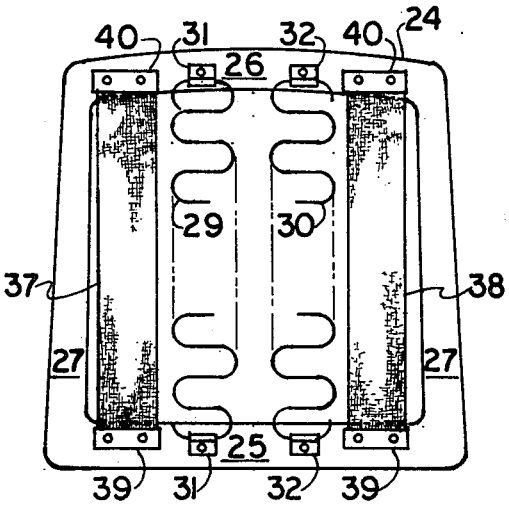
FIG. 3 is a top plan view of a modified embodiment of a spring seat in which the transversely extending outer supporting firm members complement the inner sinuous spring members.

A modified embodiment is illustrated in FIG. 3 in which the frame of the seat 24 is also provided with side rails 27 and front and rear rails 25 and 26, respectively. In place of the outer sinuous springs 33 and 34, wood slats, thin flat metal bands or very firm flexible webbing 37 and 38 may be securely fastened by suitable clamps 39 and 40 which are securely fastened to the seat frame 24 at the front and rear rails 25 and 26, respectively. The sinuous spring inner medial tensioned members 29 and 30 for supporting the ischial tuberosities 13 and 14 may be the same as shown in FIG. 2 and supported in the same manner.

Figure 4:
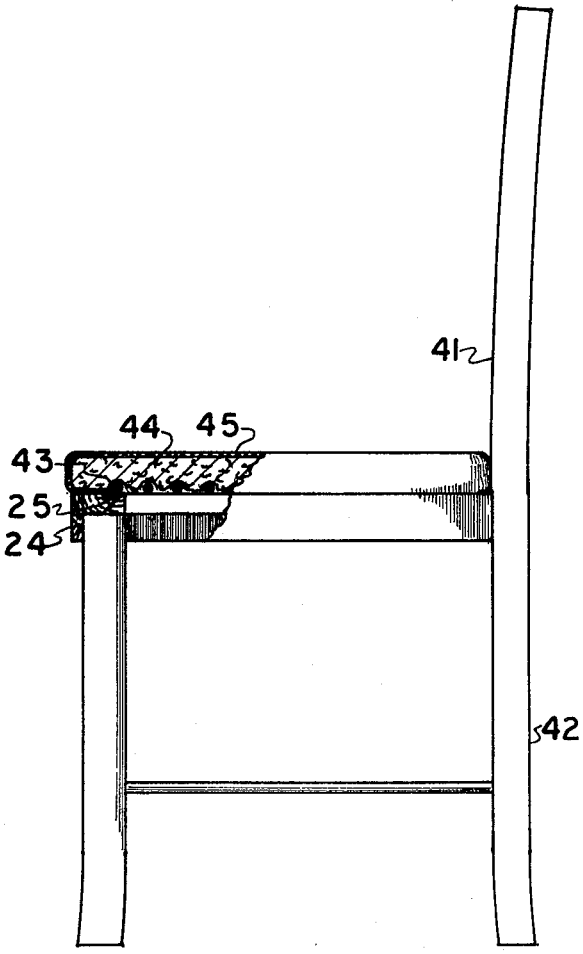
FIG. 4 is a side view of a chair having a seat with a portion removed therefrom illustrating one construction for retaining the spring seat.

A straight back chair 41 is shown in FIG. 4 having depending legs 42 with a spring seat embodying the present construction in which the seat frame 24 is of the type incorporated in FIG. 2 with the medial tensioned sinuous spring members 29 or 30 being shown fastened to the front rail 25 by the spring clip 43 that is securely fastened to the top surface of front rail 25. The outer or lateral support members 33 and 34 will be positioned on the upper surface of the seat 25 and each of the sinuous spring members 29, 30, 33 and 34 will preferably be arched upwardly slightly to reside substantially within the same plane. A padding or cushioning material such as urethane foam 44 is positioned above the spring members and is relatively thin by comparison to the more dense and thick urethane padding used in conventional seating. A suitable flexible textile or vinyl covering 45 is used to upholster over the padding 44 and envelope, at least partially, the sides and upper surfaces thereof.

Figure 5:
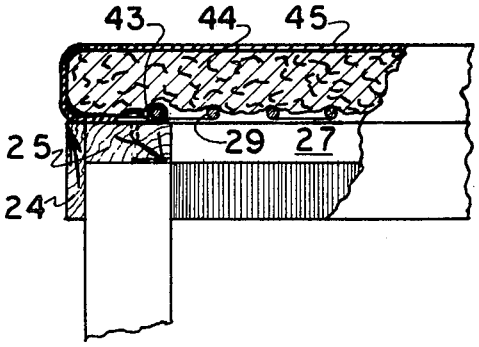
FIG. 5 is an enlarged partial transverse sectional view of a portion of the chair of FIG. 4.

An enlarged view of a portion of FIG. 4 is shown in FIG. 5 with the sinuous springs forming both the inner strands and the outer strands in order to form the desired spring seat for maximum comfort by accommodating the ischial tuberosities and to bear one-third of the load in the inner or medial bands while the outer bands and frame will support approximately two-thirds of the remaining load imposed by the occupant in the seated position.

I claim:

1. A narrow spring seat to orient a seat occupant centrally side to side comprising; a seat frame having a perimeter with connected front, rear, and side sections, two medially tensioned bands spaced apart a distance equal to the approximate spacing of the ischial tuberosities of the majority of adults, a second pair of firmer bands spaced laterally from said two medially tensioned bands on each side within the perimeter of said seat frame, the spring rate of said two medially tensioned bands being such that when the occupant sits in the seat, at the point of his buttocks compressing against said second pair of bands, his ischial tuberosities stretch the said two medially tensioned bands to support a substantial fraction of the occupant's weight.

2. A narrow spring seat as claimed in claim 1, said two medially tensioned bands being supported at substantially the same level as the said second pair of bands, said two medially tensioned bands arching upwardly to coincide in a plane substantially with said second pair of bands.

3. A narrow spring seat as claimed in claim 1, said two medially tensioned bands being sinuous springs and said second pair of bands being sinuous springs.

4. A narrow spring seat as claimed in claim 1, said two medially tensioned bands being elastic bands, and said second pair of bands being substantially rigid.

5. A narrow spring seat as claimed in claim 1, said two medially tensioned bands being sinuous springs, and said second pair of bands being substantially firm and rigidly flexible.

6. A narrow spring seat as claimed in claim 1, said two medially tensioned bands arch upwardly to the level of said second pairs of bands in a substantial portion of said two medially tensioned bands.

7. A narrow spring seat as claimed in claim 1, each of said second pair of bands being spaced from said sides of said seat frame by approximately one inch.

8. A narrow spring seat as claimed in claim 1, means for pivotally retaining said second pair of bands on said seat frame, and means for pivotally retaining said medially tensioned bands on said seat frame at the front and rear.

9. A narrow spring seat as claimed in claim 1, relatively thin cushioning means covering said pairs of bands, and covering means at least partially enveloping said cushioning means.

10. A narrow spring seat as claimed in claim 1, said two medially tensioned bands being sinuous springs and having a spring rate of standard format and slight arc utilizing approximately 10 gauge spring wire, and said second pair of bands being sinuous springs having a spring rate of approximately 8 gauge spring wire of very firm format.

* * * * *